US006511409B2

(12) United States Patent
Hachiya et al.

(10) Patent No.: US 6,511,409 B2
(45) Date of Patent: Jan. 28, 2003

(54) ROTARY DRUM OF FOLDING DEVICE

(75) Inventors: Tadashi Hachiya, Kanagawa-ken (JP); Nobuaki Hashimoto, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/906,736

(22) Filed: Jul. 18, 2001

(65) Prior Publication Data

US 2002/0019301 A1 Feb. 14, 2002

(30) Foreign Application Priority Data

Aug. 9, 2000 (JP) ..... 2000-240778

(51) Int. Cl.[7] ..... B31F 1/08
(52) U.S. Cl. ..... 493/424; 493/3
(58) Field of Search ..... 493/3, 23, 24, 493/34, 424, 425, 426

(56) References Cited

U.S. PATENT DOCUMENTS 3,710,694 A * 1/1973 Ehlscheid ..... 493/34
5,772,571 A * 6/1998 Marcle-Geller et al. .... 493/425
5,846,177 A * 12/1998 Mayr ..... 493/424
6,110,093 A * 8/2000 Slusarz ..... 492/21
6,283,906 B1 * 9/2001 Kostiza ..... 493/424
6,398,704 B1 * 6/2002 Shibuya et al. ..... 493/424

FOREIGN PATENT DOCUMENTS

JP 2-788321 6/1998
JP 2-848982 11/2001

* cited by examiner

*Primary Examiner*—Ted Kavanaugh
(74) *Attorney, Agent, or Firm*—Foley & Lardner

(57) ABSTRACT

A rotary drum of the folding device comprises a reference portion having a rotating shaft 11, 41 and a basic body 10, 40 rotated integrally with the rotating shaft 11, 41; an adjusted portion able to be rotated integrally with the reference portion and arranged so as to be displaced with respect to the reference portion; an adjusting operation mechanism having a driving source 31 for displacing the adjusted portion with respect to the reference portion, a power source 34 arranged in the reference portion, a control board 32 additionally arranged in the driving source 31 and having a wireless receiving function, and a wireless operation machine 33 for wirelessly transmitting an operation signal to the control board 32; and an adjusting transmission mechanism for transmitting a movement of the driving source 31 to the adjusted portion; wherein electric power is supplied from the power source 34 to the driving source 31, and the driving source 31 is operated by a wireless signal from the adjusting operation mechanism.

7 Claims, 4 Drawing Sheets

ROTARY DRUM OF FOLDING DEVICE

BACKGROUND OF THE INVENTION

1. Field of the Invention

This invention relates to a rotary drum of a folding device of a rotary press having an adjusting mechanism necessary to make an adjustment during rotation, e.g., a gripper drum of able to adjust the distance between a fixing side and an open-close side of a gripper mechanism, and a folding drum able to adjust an outside diameter of the drum.

2. Description of the Background Art

A gripper drum able to adjust the distance between a fixing side and an open-close side of a gripper mechanism is arranged in a device shown in Japanese Patent No. 2848982 (prior art 1).

In the prior art 1, two drum portions are arranged on the same axis as a shaft of the gripper drum and can be rotated around this shaft. The open-close side of the gripper mechanism is arranged in one of these two drum portions, and the fixing side of the gripper mechanism is arranged in the other. A spur gear is arranged in the shaft of the gripper drum, and a helical gear is arranged in one drum portion. These gears are individually engaged with each other. The shaft of the gripper drum and one drum portion can be integrally rotated through gears integrally rotated. The integrally rotated gears are moved in parallel with their rotation central line. Thus, one drum portion is connected to a portion around the shaft of the gripper drum by the action of a torsion angle of the helical gear such that this one drum portion can be angularly displaced. The other drum portion is arranged in a disk integrated with the shaft of the gripper drum, and is integrally and rotatably connected to the shaft of the gripper drum and the one drum portion through a gear group arranged between the one drum portion and the other drum portion. The other drum portion is also connected to a portion around the shaft of the gripper drum in a direction reverse to the one drum portion so as to be angularly displaced in accordance with the angular displacement around the shaft of the gripper drum of the one drum portion.

Helical gears having torsion in directions reverse to each other are separately arranged in accordance with the spur gear formed in the shaft of the gripper drum in the one drum portion and the other drum portion. These gears, i.e., the spur gear arranged in the shaft of the gripper drum, and the helical gear arranged in the one drum portion and the helical gear arranged in the other drum portion are individually engaged with each other. The shaft of the gripper drum and the two drum portions can be integrally rotated through gears integrally rotated. Further, the integrally rotated gears are moved in parallel with their rotation central axis. The two drum portions are connected by this movement to each other around the shaft of the gripper drum so as to be angularly displaced in directions reverse to each other by the action of a torsion angle of the helical gear.

A folding drum able to adjust its outside diameter is known in Japanese Patent No. 2788321 (prior art 2). In a device described in the prior art 2, an outer circumferential face of the folding drum having plural folding mechanisms in equal divisional positions is divided into two portions between two adjacent folding mechanisms. A portion adjacent to an upstream side of the folding mechanisms in a rotating direction of the folding drum among these two divided portions is rotatably supported with an axis parallel to that of the folding drum as a center. A rear end portion of this outer circumferential portion is movably arranged toward a radial outer side by an adjusting device as an eccentric shaft. The remaining outer circumferential portion is fixedly arranged.

In a state in which the rotation of the folding drum is stopped, the diameter of the folding drum is adjusted by individually rotating the eccentric shaft by a tool. A gear is attached to an end portion of the eccentric shaft, and a rack portion engaged with this gear is arranged. Further, an adjusting ring having a rotation center common to the folding drum and able to be rotated with respect to the folding drum is arranged. The adjusting ring is rotated with respect to the folding drum by an electric motor having this adjusting ring within the folding drum, and the respective eccentric shafts of the plural folding mechanisms are simultaneously rotated so that the outside diameter of the folding drum is adjusted.

The devices shown in the prior arts 1 and 2 have the following problems to be solved. In the device shown in the prior art 1, the two drum portions can be simultaneously rotated as if these two drum portions were integrated with the shaft of the gripper drum, Further, it is necessary to arrange a relatively large gear having the same pitch circle diameter in the gripper drum shaft and the two drum portions so as to angularly displace the rotating two drum portions around the gripper drum shaft from an outer side of the gripper drum in directions reverse to each other. Furthermore, it is necessary to arrange plural gears individually engaged with these gears and integrally rotated around the same rotation center, and arrange a mechanism for displacing these plural gears along their rotation center line while these plural gears are rotated. Therefore, the device construction becomes complicated, and failure probability is increased. Further, maintenance is complicated since many parts are assembled into a narrow space between the gripper drum and a frame. Furthermore, the number of parts is large, and processing and assembly ate complicated so that a relatively large number of processes are required, and manufacturing cost is high.

The device disclosed in the prior art 2 solves the problems caused by complication of the construction of the prior art 1 and a large number of parts. However, in the construction adjusted by a manual work using a tool, it is necessary to stop the rotation of the folding drum every adjustment, and working efficiency is extremely low. In the construction for operating the adjusting mechanism by the electric motor arranged within the folding drum, it is difficult to supply electric power to the electric motor and supply a control signal to the electric motor so that there is a fear that no accurate adjustment is made. Namely, in the construction for operating the adjusting mechanism shown in the prior art 2 by the electric motor arranged within the folding drum, there is no special device for supplying electric power to the electric motor arranged within the folding drum of a rotating body and supplying the control signal. Accordingly, it is considered that these electric power and control signal are supplied by using a general slip ring. However, this slip ring is used to supply electric power and the control signal by mechanical contact using a brush. Therefore, there are many cases in which sparks and noises are caused. Accordingly, there is a fear of generation of a fire and an error in operation of a control circuit is caused. Further, the slip ring is low in durability of the mechanical contact using the brush. One slip ring for high speed rotation sold at a market is about 300 r.p.m., and has only 20000 thousand rotations in durability. Accordingly, when this slip ring is used in the folding device of the rotary press, it is necessary to exchange or maintain the slip ring every half a year in an operation in which the folding device is operated for six hours per one day. Therefore, in the meantime, the operation of the folding device is stopped so that working efficiency is reduced.

SUMMARY OF THE INVENTION

To solve the above problems, the present invention proposes a rotary drum of a folding device comprising a reference portion having a rotating shaft and a basic body rotated integrally with the rotating shaft; an adjusted portion able to be rotated integrally with the reference portion and arranged so as to be displaced with respect to the reference portion; an adjusting operation mechanism having a driving source for displacing the adjusted portion with respect to the reference portion, a power source arranged in the reference portion, a control board additionally arranged in the driving source and having a wireless receiving function, and a wireless operation machine for wirelessly transmitting an operation signal to the control board; and an adjusting transmission mechanism for transmitting a movement of the driving source to the adjusted portion; wherein electric power is supplied from the power source to the driving source, and the driving source is operated by a wireless signal from the adjusting operation mechanism.

The present invention also provides a rotary drum of a folding device comprising a reference portion having a rotating shaft and a basic body rotated integrally with the rotating shaft; an adjusted portion able to be rotated integrally with the reference portion and arranged so as to be displaced with respect to the reference portion, and having a shaft arranged in the basic body and displaced by a torsion spring in one direction, an eccentric portion arranged in the shaft, a block member arranged rotatably with respect to the eccentric portion, and an outer circumferential member spanned between a pair of block members; an adjusting operation mechanism having an electric motor as a driving source for displacing the adjusted portion with respect to the reference portion, a power source arranged in the reference portion, a control board additionally arranged in the driving source and having a wireless receiving function, and a wireless operation machine for wirelessly transmitting an operation signal to the control board; and an adjusting transmission mechanism having a warm arranged in an output shaft of the electric motor to transmit a movement of the electric motor to the adjusted portion, a warm wheel engaged with the warm and attached so as to be rotated integrally with the rotating shaft, a first gear able to be rotated with respect to the rotating shaft and attached to the electric motor, and a second gear engaged with the first gear and attached so as to be rotated integrally with the shaft; wherein electric power is supplied from the power source to the electric motor, and the electric motor is operated by a wireless signal from the adjusting operation mechanism.

Further, the present invention provides a rotary drum of a folding device comprising a reference portion having a rotating shaft and a basic body rotated integrally with the rotating shaft; an adjusted portion able to be rotated integrally with the reference portion and arranged so as to be displaced with respect to the reference portion, and having pairs of first and second side plates arranged rotatably with respect to the basic body on both sides of the basic body, a third side plate attached to the other side of the basic body from outer sides of these first and second side plates and able to be rotated integrally with the basic body, an adjusting shaft rotatably arranged in the basic body and the third side plate, a first eccentric cam attached through a first slip member movable only in a radial direction of the first side plate in a position of the adjusting shaft corresponding to the first side plate, a second eccentric cam attached through a second slip member movable only in a radial direction of the second side plate in a position of the adjusting shaft corresponding to the second side plate, an angular displacement shaft able to be angularly displaced and spanned between the first side plates, a displacing member attached to the angular displacement shaft, and a fixing member fixedly arranged so as to be opposed to the displacing member between the second side plates; an adjusting operation mechanism having an electric motor attached to the third side plate as a driving source for displacing the adjusted portion with respect to the reference portion, a power source arranged in the reference portion, a control board additionally arranged in the driving source and having a wireless receiving function, and a wireless operation machine for wirelessly transmitting an operation signal to the control board; an adjusting transmission mechanism having a warm arranged in an output shaft of the electric motor to transmit a movement of the electric motor to the adjusted portion, and a warm wheel engaged with the warm and attached so as to be rotated integrally with the adjusting shaft; wherein electric power is supplied from the power source to the electric motor, and the electric motor is operated by a wireless signal from the adjusting operation mechanism.

In the above rotating drum of the folding device, the power source can be constructed by a generator constructed by a magnet externally fixed and a winding portion surrounding the magnet in a state close to a peripheral portion of the magnet such that the winding portion can be rotated together with the reference portion. The power source can be also constructed by a rotary transformer in which a coil is wound around each cut iron core portion, and one side is set to a fixing winding portion externally fixed and able to supply electric power from the exterior, and the other side is a rotation winding portion able to be rotated together with the reference portion.

DESCRIPTION OF THE PREFERRED EMBODIMENTS

Figure 1:
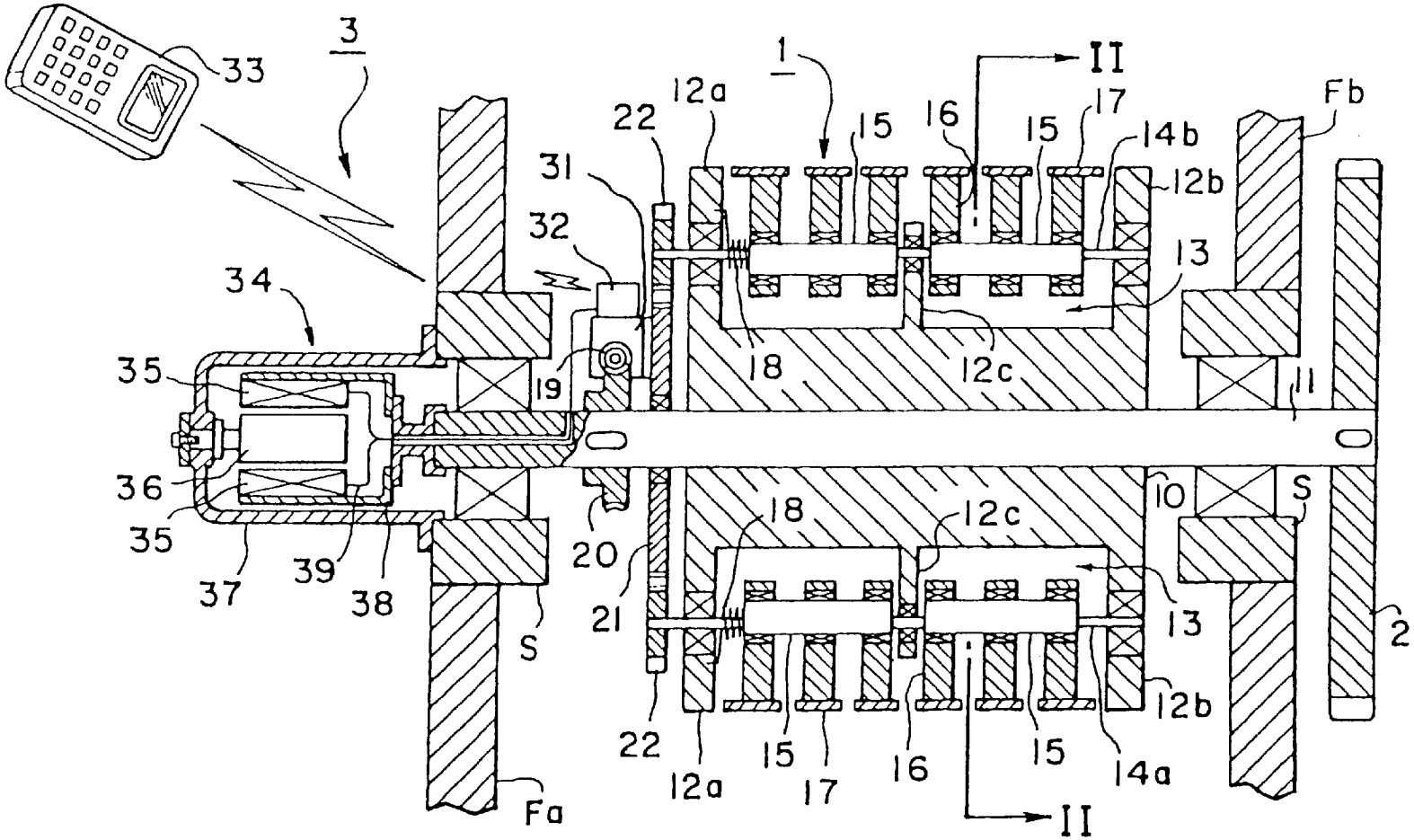
FIG. 1 is a cross-sectional view schematically taken along an arrow A—A of FIG. 2 in parallel therewith in a first embodiment mode of a rotary drum of a folding device in the present invention.
Figure 2:
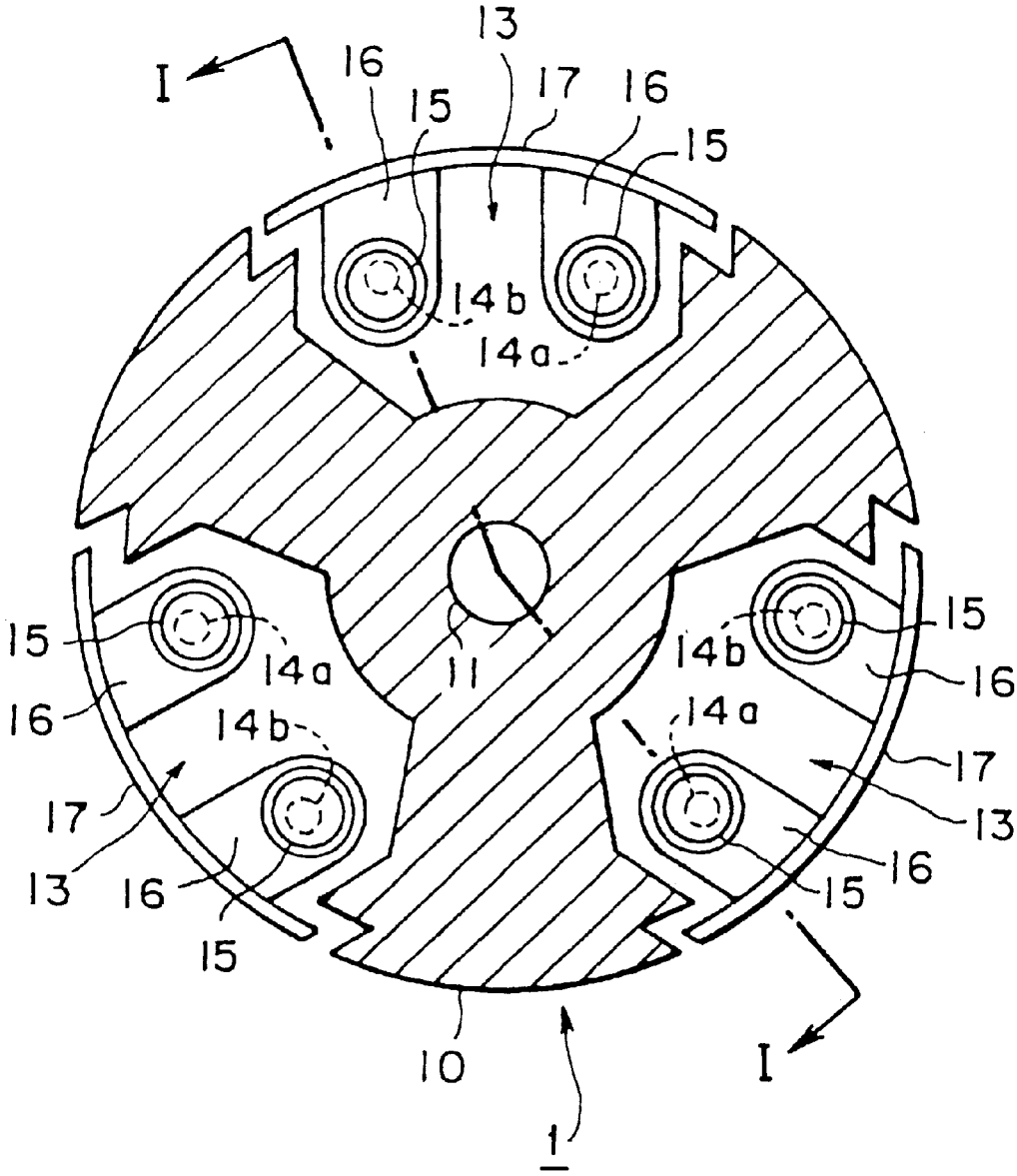
FIG. 2 is a cross-sectional view taken along an arrow B—B of FIG. 1.
Figure 3:
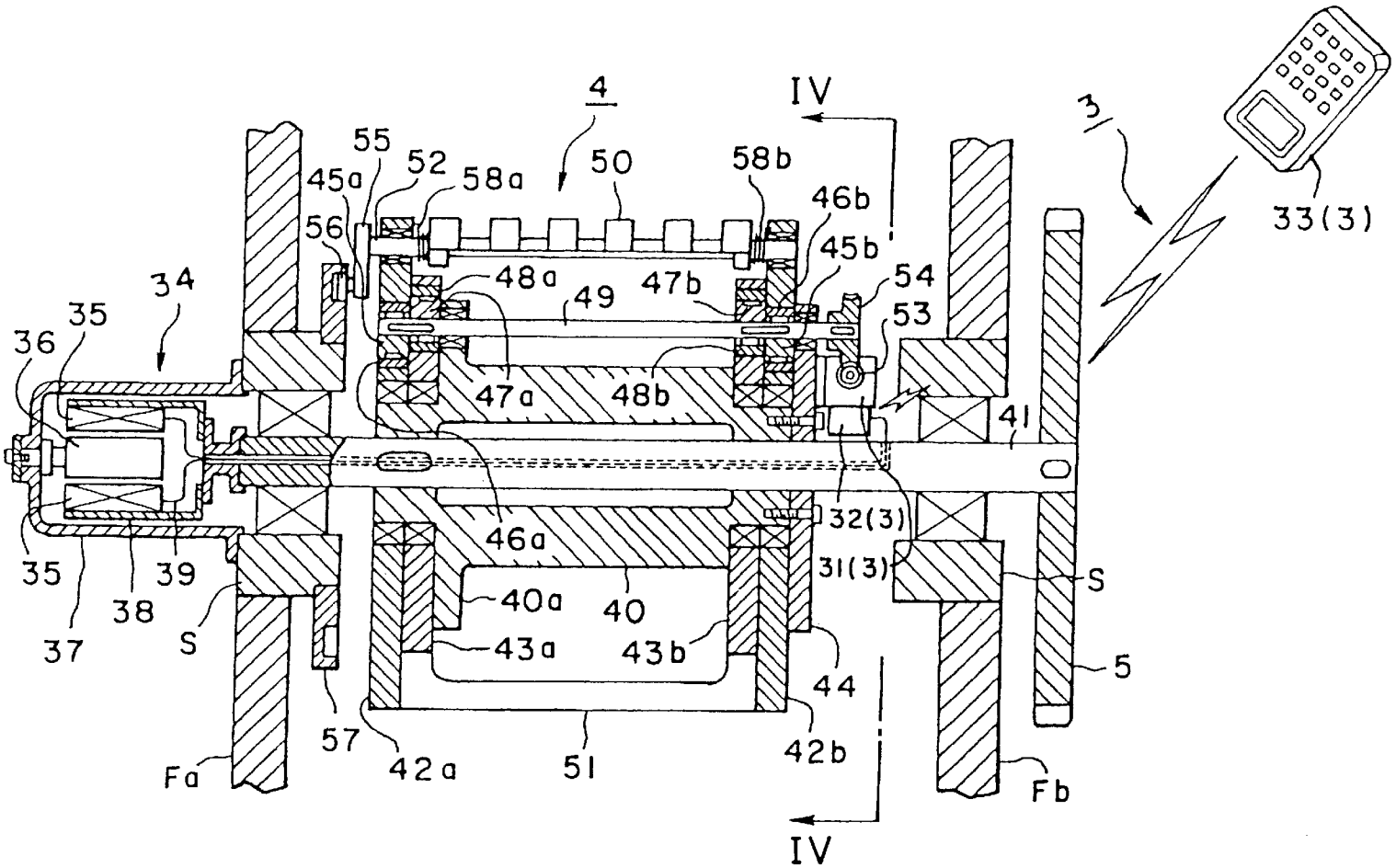
FIG. 3 is a cross-sectional view schematically taken along an arrow C—C of FIG. 4 in parallel therewith in a second embodiment mode of the rotary drum of the folding device of the present invention.
Figure 4:
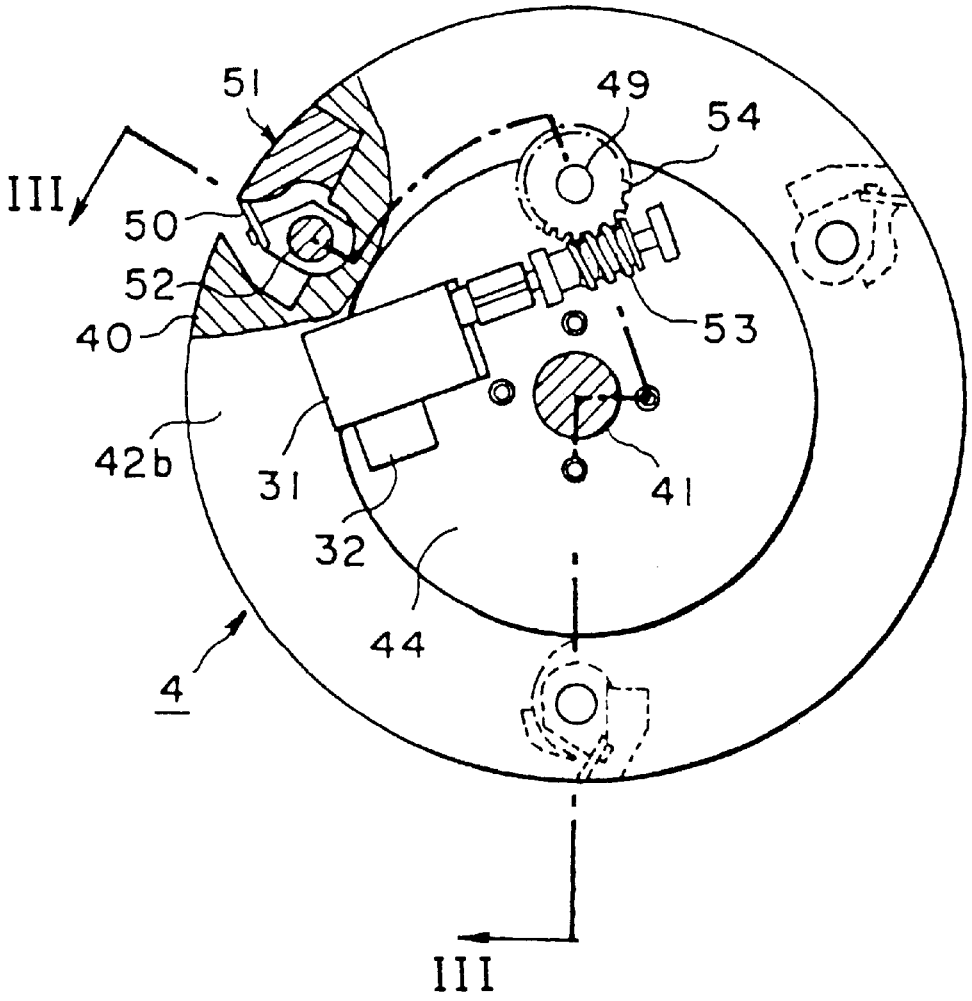
FIG. 4 is a partial sectional view taken along an arrow D—D of FIG. 3.

A first embodiment mode of a rotary drum of a folding device in the present invention will be explained on the basis of FIGS. 1 and 2. FIG. 1 is a cross-sectional view schematically taken along an arrow A—A of FIG. 2 in parallel therewith. FIG. 2 is a cross-sectional view taken along an arrow B—B of FIG. 1. A second embodiment mode of the rotary drum of the folding device of this invention will be explained on the basis of FIGS. 3 and 4. FIG. 3 is a cross-sectional view schematically taken along an arrow C—C of FIG. 4 in parallel therewith. FIG. 4 is a partial sectional view taken along an arrow D—D of FIG. 3.

First, the first embodiment mode of this invention will be explained on the basis of FIGS. 1 and 2. A folding drum 1 as a rotary drum has a reference portion, an adjusted portion, an adjusting operation mechanism, and an adjusting transmission mechanism. The reference portion has a basic body 10 and a rotating shaft 11. The adjusted portion has shafts 14*a,* 14*b* able to be rotated integrally with the reference portion and arranged in the basic body 10 so as to be displaced with respect to the reference portion. The adjusted portion also has an eccentric portion 15, a block member 16, an outer circumferential member 17 and a torsion spring 18. The adjusting operation mechanism has an electric motor 31 as a driving source for displacing the adjusted portion with respect to the reference portion, a generator 34 as a power source arranged in the reference portion, a control board 32 additionally arranged in the driving source and having a wireless receiving function, and a wireless operation machine 33 for wirelessly transmitting an operation signal to the control board 32. The adjusting transmission mechanism has a warm 19, a warm wheel 20, a first gear 21 and a second gear 22 to transmit a movement of the electric motor 31 to the adjusted portion.

The basic body 10 is formed between side plates 12*a* and 12*b* arranged on both axial sides of the basic body 10 such that plural grooves 13 parallel to the rotating shaft 11 are opened to an outer circumferential face of the basic body 10. In this embodiment mode, the number of grooves 13 is set to three. In each of the three grooves 13, a pair of shafts 14*a,* 14*b* are supported between both the side plates 12*a* and 12*b* and are also supported by an intermediate support plate 12*c* so as to be angularly displaced. One end of each of the shafts 14*a,* 14*b* is projected outward from the side plate 12*a*. A rotatable second gear 22 is arranged in a projecting portion of each of the shafts 14*a,* 14*b* projected outward from the side plate 12*a,* and is angularly displaced integrally with each of the shafts 14*a,* 14*b*. The eccentric portion 15 is arranged between the intermediate support portion 12*c* of each of the shafts 14*a,* 14*b* and each of both the side plates 12*a,* 12*b* so as to be angularly displaced integrally with the shafts 14*a,* 14*b*.

Plural block members 16 are arranged in the eccentric portion 15 of each of the shafts 14*a,* 14*b* so as to be rotated with respect to the eccentric portion 15. In this embodiment mode, the number of block members 16 arranged in the eccentric portion 15 of each of the shafts 14*a,* 14*b* is set to six. Each of the block members 16 is relatively arranged with respect to the pair of shafts 14*a,* 14*b*. An outer circumferential portion 17 is spanned between the pair of corresponding block members 16 and 16. Each outer circumferential member 17 has an outer circumferential face approximately aligned with a columnar outer circumferential face of the basic body 10 in a state in which the outer circumferential member 17 is attached to the pair of block members 16, 16.

A torsion spring 18 is attached to each of the shafts 14*a,* 14*b* and gives biasing force for displacing each of these shafts in one direction at any time. Further, in a state in which the second gear 22 arranged in an end portion of each of the shafts 14*a,* 14*b* projected onto an outer side of the side plate 12*a* is engaged with the first gear 21, rotating phases of the two shafts 14*a,* 14*b* every pair are set to be approximately in conformity with each other. The height of an arc outer circumferential face of the outer circumferential member 17 attached to three pairs of the shafts 14*a,* 14*b* through the block member 16 is approximately conformed to that of the columnar outer circumferential face of the basic body 10.

The reference portion is constructed by the basic body 10 having the columnar outer circumferential face and the rotating shaft 11 rotated integrally with the basic body 10. The warm wheel 20 and the first gear 21 are attached to the rotating shaft 11. The warm wheel 20 is rotated integrally with the rotating shaft 11 and is set to an origin of the adjusting transmission mechanism. The first gear 21 can be rotated with respect to the rotating shaft 11 and constitutes one portion of the adjusting transmission mechanism. The warm wheel 20 and the first gear 21 are sequentially arranged from a frame Fa side. The rotating shaft 11 is rotatably supported by frames Fa, Fb, and a driven gear 2 is attached to one side of the rotating shaft 11 projected outward from the frame Fb. The rotating shaft 11 is rotated by driving force from an unillustrated driving means through the driven gear 2.

The electric motor 31 as a driving source is attached to a side face of the first gear 21 opposed to the frame Fa. The control board 32 able to wirelessly transmit and receive signals is additionally arranged in the electric motor 31, and is operated on the basis of a control signal from the external wireless operation machine 33 as one portion of the adjusting operation mechanism 3. For example, the electric motor 31 has a speed reduction function, and uses a type having a feedback function in which a rotating amount can be fed back to the wireless operation machine 33 through the control board 32 additionally arranged.

The warm 19 constituting the adjusting transmission mechanism is attached to an output shaft of the electric motor 31, and is engaged with the warm wheel 20. Since the warm 19 is engaged with the warm wheel 20, the first gear 21 can be rotated integrally with the rotating shaft 11 through the electric motor 31, the warm 19 and the warm wheel 20.

The adjusting operation mechanism 3 has the electric motor 31 as a driving source, the control board 32 additionally arranged in the electric motor 31 and having a wireless transmitting and receiving function, the wireless operation machine 33 operated by a wireless operation signal from the exterior, and the generator 34 operated by rotating the folding drum 1 as a rotary drum.

The generator 34 has a columnar magnet 36 fixed to the frame Fa through a sleeve S and a support case 37 so as to have the same center line as a rotation center line of the rotating shaft 11. The generator 34 also has a winding portion 35 attached to the rotating shaft 11 as the reference portion of the rotary drum through the support member 38, and rotated integrally with the rotating shaft 11 around the same center line as the rotating shaft 11. The winding portion 35 surrounds a peripheral portion of the magnet 36. Electric power is generated in the winding portion 35 by rotating the winding portion 35 around the magnet 36 as the rotating shaft 11 is rotated.

In FIGS. 1 and 2, the generator 34 can be also replaced by a transformer, e.g., a rotary transformer, etc. When the generator 34 is replaced by the rotary transformer, a primary coil side is set to a fixing winding portion externally fixed, and is arranged such that electric power can be supplied from the exterior to this primary coil side. A secondary coil side is arranged as a rotation winding portion able to be rotated together with the rotating shaft. When electric power is supplied to the primary coil side constructed in this way, electric power determined by winding numbers of both the coils is obtained in the secondary coil irrespective of the rotation of the rotating shaft 11.

In this embodiment mode, the electric motor 31 is a pulse motor with a speed reduction gear. The electric motor 31 is operated by the wireless operation machine 33 having a wireless transmitting and receiving function for operating the electric motor 31 through the control board 32. A radio wave is generally utilized as a wireless communication medium between the wireless operation machine 33 and the control board 32, but various kinds of communication means such as an ultrasonic wave, light, etc. can be also used.

The folding drum 1 has a paper holding mechanism, a folding blade driving mechanism, a timing adjusting mechanism, etc. although such mechanisms are not illustrated. The paper holding mechanism holds overlapped paper as a folded object to introduce this paper onto the outer circumferential face of the folding drum 1. The folding blade driving mechanism pushes up a folding portion of the overlapped paper by a folding blade projected from the outer circumferential face of the folding drum 1. The timing adjusting mechanism adjusts operation timings of these mechanisms.

An operation of the rotary drum in the first embodiment mode of this invention will next be explained. The folding drum 1 as the rotary drum is rotated by the driven gear 2 rotated by an unillustrated driving means, and folds overlapped paper in cooperation with an adjacent drum such as a gripper drum, etc. In this operation, the warm wheel 20 attached to the rotating shaft 11 is rotated in alignment with the basic body 10. The first gear 21 rotatably attached to the rotating shaft 11 is connected to the electric motor 31 attached to a side face of the first gear 21, the warm 19 attached to the output shaft of the electric motor 31, and the warm wheel 20 engaged with the warm 19. Accordingly, the first gear 21 is rotated at the same angular velocity as the warm wheel 20, i.e., is rotated integrally with the rotating shaft 11. Further, since the second gear 22 engaged with the first gear 21 is attached to the basic body 10 rotated at the same angular velocity as the first gear 21, no second gear 22 itself is rotated, and no shafts 14*a,* 14*b* attached to the second gear 22 are rotated.

In this state, when it is necessary to adjust an outside diameter of the folding drum 1 in accordance with a thickness of the overlapped paper folded by the folding drum 1, the adjustment is made by the adjusting operation mechanism 3 as follows. Namely, a predetermined desirable operation signal is first wirelessly transmitted to the control board 32 of the electric motor 31 using the wireless operation machine 33. The control board 32 receiving the operation signal outputs an operation signal for controlling an operation of the electric motor 31 to the electric motor 31 in accordance with the received operation signal. The electric motor 31 is rotated in accordance with the operation signal. The electric motor 31 outputs a feedback signal proportional to an operating amount of the electric motor 31 by an unillustrated attached rotary encoder. This feedback signal is converted by the control board 32 to a signal relating to a rotating amount of the electric motor 31, and is wirelessly transmitted by the control board 32, and is used to notify the rotating amount of the electric motor 31 to an operator through the wireless operation machine 33.

Electric power for operating the electric motor 31 and the control board 32 is supplied from the generator 34 or a transformer (rotary transformer) additionally arranged in the folding drum 1. Namely, the magnet 36 fixed to the frame Fa is surrounded through the support case 37 and the sleeve S in the generator 34, and the winding portion 35 fixed to an end portion of the rotating shaft 11 through the support member 38 is rotated as the rotating shaft 11 is rotated. Thus, an electric current flows through the winding portion 35 moving across a magnetic line. This electric current is supplied to the control board 32 and the electric motor 31 by a conductive lead 39, and is used as electric power for operating the control board 32 and the electric motor 31.

When the electric motor 31 is rotated, the warm 19 attached to the output shaft of the electric motor 31 is rotated and begins to rotate the warm wheel 20 engaged with this warm 19. However, the warm wheel 20 is attached to the rotating shaft 11 so as not to be rotated. In contrast to this, the electric motor 31 attaching the warm 19 thereto can be rotated with respect to the rotating shaft 11 through the first gear 21. Therefore, the warm 19, the electric motor 31 and the first gear 21 are rotated and displaced integrally with the rotating shaft 11. While the warm 19, etc. are rotated and displaced, the warm 19 is engaged with the warm wheel 20 and is displaced along a circumferential face of the warm wheel 20.

When the first gear 2l is rotated and displaced with respect to the rotating shaft 11, a rotating phase of the first gear 21 is changed with respect to the rotation of the basic body 10. Thus, plural second gears 22 engaged with the first gear 21 are simultaneously angularly displaced with respect to the basic body 10, and plural shafts 14*a,* 14*b* attached to the second gears 22 are angularly displaced. When the shafts 14*a,* 14*b* are angularly displaced, the block member 16 is moved in a radial direction of the basic body 10 by an angular displacement action of the eccentric portion 15 arranged integrally with the shafts 14*a,* 14*b*. Therefore, the outer circumferential member 17 attached to the block member 16 is also moved in the radial direction of the basic body 10. The outside diameter of the folding drum 1 is adjusted by this movement of the outer circumferential member 17 in the radial direction.

Next, a second embodiment mode of this invention will be explained on the basis of FIGS. 3 and 4. In the second embodiment mode, the rotary drum is a gripper drum 4, and the adjusted portion is a distance adjusting mechanism of a gripper plate 50 and a gripper jaw 51.

The gripper drum 4 as the rotary drum has a reference portion, an adjusted portion, an adjusting operation mechanism and an adjusting transmission mechanism. The reference portion has a basic body 40 and a rotating shaft 41. The adjusted portion has a pair of first side plates 42*a,* 42*b* and a pair of second side plates 43*a,* 43*b*. The pair of first side plates 42*a,* 42*b* and the pair of second side plates 43*a,* 43*b* can be rotated integrally with the reference portion, and are arranged so as to be angularly displaced with respect to the reference portion, and can be arranged on both sides of the basic body 40 so as to be rotated with respect to the basic body 40. The adjusted portion also has a third side plate 44 attached to the other side of the basic body 40 from outer sides of these first and second side plates and able to be rotated integrally with the basic body 40. The adjusted portion also has first eccentric cams 45*a,* 45*b,* first slip members 46*a,* 46*b,* second eccentric cams 47*a,* 47*b,* second slid members 48*a,* 48*b,* an adjusting shaft 49, a gripper plate 50 as a displacing member, and a gripper jaw 51 as a fixing member. The adjusting operation mechanism has an electric motor 31 as a driving source for displacing the adjusted portion with respect to the reference portion, a generator 34 as a power source arranged in the reference portion, a control board 32 additionally arranged in the driving source and having a wireless receiving function, and a wireless operation machine 33 for wirelessly transmitting an operation signal to the control board 32. The adjusting transmission mechanism transmits a movement of the electric motor 31 to the adjusted portion, and has a warm 53 and a warm wheel 54.

The reference portion of the gripper drum 4 as the rotary drum is constructed by the basic body 40 and the rotating shaft 41 rotated integrally with the basic body 40. The basic body 40 has a columnar outer circumferential face and a flange portion 40*a* in a side face portion in a rotating axis direction. The rotating shaft 41 is rotatably supported by frames Fa, Fb. A driven gear 5 is attached to one side of the rotating shaft 41 projected outward from the frame Fb. The rotating shaft 41 is rotated by driving force from an unillustrated driving means through the driven gear 5.

The electric motor 31 as a driving source is attached to a side face of the third side plate 44 opposed to the frame Fb. The control board 32 able to wirelessly transmit and receive signals is additionally arranged in the electric motor 31, and the electric motor 31 is operated on the basis of an operation signal from the external wireless operation machine 33 as the adjusting operation mechanism 3. For example, the electric motor 31 has a speed reduction function and uses a type having a feedback function in which a rotating amount can be fed back to the wireless operation machine 33 through the control board 32 additionally arranged.

The warm 53 as one portion of the adjusting transmission mechanism is attached to the output shaft of the electric motor 31, and is engaged with the warm wheel 54 projected from the third side plate 44. The warm wheel 54 is fixed to an end portion of the adjusting shaft 49.

The respective distances between the first side plates 42*a*, 42*b* and the second side plates 43*a*, 43*b* as adjusted portions are constantly maintained by unillustrated suitable stays. A gripper plate shaft 52 attached to the gripper plate 50 as a displacing member is spanned between the first side plates 42*a* and 42*b*. The gripper plate shaft 52 as an angular displacement shaft is supported such that this gripper plate shaft 52 is angularly displaced. The gripper jaw 51 as a fixing member is fixed between the second side plates 43*a* and 43*b* such that the gripper jaw 51 is opposed to the gripper plate 50. One end of an arm 55 is fixed to an end portion of the gripper plate shaft 52 extending through the first side plate 42*a* on one side. A cam follower 56 is rotatably attached to the other end of the arm 55 through a pin parallel to the gripper plate shaft 52. The cam follower 56 is attached such that the cam follower 56 follows a groove cam 57 arranged in a sleeve S. Torsion springs 58*a*, 58*b* are attached between the gripper plate shaft 52 and the first side plates 42*a*, 42*b*, and prevents a free displacement of the gripper plate shaft 52 due to a play caused by errors in processing, assembly, etc.

The adjusting shaft 49 is rotatably supported between the basic body 40 and a flange portion 40*a* arranged on one side of the basic body 40. The first eccentric cams 45*a*, 45*b* coming in close contact with the first side plates 42*a*, 42*b* are arranged in the adjusting shaft 49 in positions corresponding to the first side plates 42*a*, 42*b* through the first slip members 46*a*, 46*b* movable only in a radial direction of the gripper drum 4. The second eccentric cams 47*a*, 47*b* coming in close contact with the second side plates 43*a*, 43*b* are arranged in the adjusting shaft 49 in positions corresponding to the second side plates 43*a*, 43*b* through the second slip members 48*a*, 48*b* movable only in the radial direction of the gripper drum 4. The first eccentric cams 45*a*, 45*b* are eccentrically arranged by the same size in the same direction with respect to a center of the adjusting shaft 49. The second eccentric cams 47*a*, 47*b* are eccentrically arranged by the same size as the first eccentric cams 45*a*, 45*b* in a direction reverse to that of the first eccentric cams 45*a*, 45*b* with respect to the center of the adjusting shaft 49.

Accordingly, when the adjusting shaft 49 is rotated, the first side plates 42*a*, 42*b* and the second side plates 43*a*, 43*b* are angularly displaced in directions reverse to each other around a center of the rotating shaft 41, and the distance between the gripper plate 50 and the gripper jaw 51 can be adjusted in accordance with the thickness of paper to be gripped. Further, the warm wheel 54 engaged with the warm 19 attached to the output shaft of the electric motor 31 is rotatably attached integrally with the adjusting shaft 49 at the other end of the adjusting shaft 49 from which the third side plate 44 is projected The adjusting operation mechanism 3 has the electric motor 31 as a driving source, the control board 32 having a wireless transmitting and receiving function additionally arranged in the electric motor 31, the wireless operation machine 33 operated by a wireless operation signal from the exterior, and the generator 34 operated by rotating the gripper drum 4 as the rotary drum.

The generator 34 has a columnar magnet 36 and a winding portion 35. The magnet 36 is fixed to the frame Fa so as to have the same center line as a rotation center line of the rotating shaft 11 through the sleeve S and the support case 37. The wiring portion 35 is attached to the rotating shaft 11 as a reference portion of the rotary drum through the support member 38. The winding portion 35 is rotated integrally with the rotating shaft 11 around the same center line as the rotating shaft 11. The winding portion 35 surrounds a peripheral portion of the magnet 36. Electric power is generated in the winding portion 35 by rotating the winding portion 35 around the magnet 36 as the rotating shaft 11 is rotated.

In FIGS. 3 and 4, the generator 34 can be also replaced by a transformer, e.g., a rotary transformer, etc. When the generator 34 is replaced by the rotary transformer, a primary coil side is set to a fixing winding portion externally fixed, and is arranged such that electric power can be supplied from the exterior to this primary coil side. A secondary coil side is arranged as a rotation winding portion able to be rotated together with the rotating shaft. When electric power is supplied to the primary coil side constructed in this way, electric power determined by winding numbers of both the coils is obtained in the secondary coil irrespective of the rotation of the rotating shaft 11.

In this embodiment mode, the electric motor 31 is a pulse motor with a speed reduction gear. The electric motor 31 is operated by the wireless operation machine 33 having a wireless transmitting and receiving function for operating the electric motor 31 through the control board 32. A radio wave is generally utilized as a wireless communication medium between the wireless operation machine 33 and the control board 32, but various kinds of communication means such as an ultrasonic wave, light, etc. can be also used.

In addition to the above mechanisms, a timing adjustment mechanism for adjusting operation timing of the gripper plate 50, etc. are arranged in the gripper drum 4 although this arrangement is not illustrated.

An operation of the rotary drum in the second embodiment mode of this invention will next be explained. The gripper drum 4 is rotated by the driven gear 5 rotated by an unillustrated driving means, and folds overlapped paper in cooperation with an adjacent drum such as a folding drum, etc. In this operation, when the rotating shaft 41 is rotated, the basic body 40 and the third side plate 44 forming the reference portion together with the rotating shaft 41 are integrally rotated. The first side plates 42*a*, 42*b* rotatably attached to the basic body 40 are connected to the basic body 40 through the first slip members 46*a*, 46*b*, the first eccentric cams 45*a*, 45*b* coming in close contact with the first side plates 42*a*, 42*b* through the first slip members 46*a*, 46*b*, the adjusting shaft 49 attaching the first eccentric cams 45*a*, 45*b* thereto, the warm wheel 54 attached to the other end of the adjusting shaft 49, the warm 53 engaged with this warm wheel 54, the electric motor 31 having the output shaft attached to the warm 53 and attached to the third side plate 44, and the third plate 44. The second side plates 43*a,* 43*b* rotatably attached to the basic body 40 are connected to the basic body 40 through the second slip members 48*a,* 48*b,* the second eccentric cams 47*a,* 47*b* coming in close contact with the second side plates 43*a,* 43*b* through the second slip members 48*a,* 48*b,* the adjusting shaft 49 attaching the second eccentric cams 47*a,* 47*b* thereto, the warm wheel 54 attached to the other end of the adjusting shaft 49, the warm 53 engaged with this warm wheel 54, the electric motor 31 having the output shaft attached to the warm 53 and attached to the third side plate 44, and the third side plate 44. Accordingly, the first side plates 42*a,* 42*b,* the second side plates 43*a,* 43*b,* and the respective constructional members for connecting these side plates to the basic body 40 are rotated integrally with the reference portion at the same speed as the basic body 40.

In this state, when it is necessary to adjust the distance between the gripper plate 50 and the gripper jaw 51 of the gripper drum 4 in accordance with the thickness of the overlapped paper to be folded, the adjustment is made by the adjusting operation mechanism 3 as follows. Namely, a predetermined desirable operation signal is first wirelessly transmitted to the control board 32 of the electric motor 31 using the wireless operation machine 33. The control board 32 receiving the operation signal outputs an operation signal for controlling an operation of the electric motor 31 to the electric motor 31 in accordance with the received operation signal. The electric motor 31 is rotated in accordance with the operation signal. The electric motor 31 outputs a feedback signal proportional to an operating amount of the electric motor 31 by an unillustrated attached rotary encoder. This feedback signal is converted by the control board 32 to a signal relating to a rotating amount of the electric motor 31, and is wirelessly transmitted by the control board 32, and is used to notify the rotating amount of the electric motor 31 to an operator through the wireless operation machine 33.

Electric power for operating the electric motor 31 and the control board 32 is supplied from the generator 34 or a transformer (rotary transformer) additionally arranged in the folding drum 1. Namely, the magnet 36 fixed to the frame Fa is surrounded through the support case 37 and the sleeve S in the generator 34, and the winding portion 35 fixed to an end portion of the rotating shaft 11 through the support member 38 is rotated as the rotating shaft 11 is rotated. Thus, an electric current flows through the winding portion 35 moving across a magnetic line. This electric current is supplied to the control board 32 and the electric motor 31 by a conductive lead 39, and is used as electric power for operating the control board 32 and the electric motor 31. When electric power is supplied from the exterior to a primary coil in the transformer (rotary transformer), electric power determined by a ratio of winding numbers of the primary coil and a secondary coil is obtained on the secondary coil side, and is supplied to the control board 32 and the electric motor 31 by a conductive lead connected to the secondary coil, and is used as electric power for operating the control board 32 and the electric motor 31.

When the electric motor 31 is rotated, the warm 53 attached to the output shaft of the electric motor 31 is rotated, and rotates the warm wheel 54 engaged with this warm 53. Thus, the warm wheel 54 is angularly displaced with respect to the third side plate 44, i.e., the basic body 40 so that the adjusting shaft 49 attaching the warm wheel 54 thereto is angularly displaced. When the adjusting shaft 49 is angularly displaced, the first eccentric cams 45*a,* 45*b* and the second eccentric cams 47*a,* 47*b* integrally attached to the adjusting shaft 49 are angularly displaced. Force in a direction perpendicular to a radial direction is then applied to the first side plates 42*a,* 42*b* through the first slip members 46*a,* 46*b* by the angular displacements of the first eccentric cams 45*a,* 45*b*. Further, force in a direction reverse to the direction of the force applied to the first side plates 42*a,* 42*b* is applied to the second side plates 43*a,* 43*b* through the second slip members 48*a,* 48*b* by the angular displacements of the second eccentric cams 47*a,* 47*b*. As a result, the first side plates 42*a,* 42*b* and the second side plates 43*a,* 43*b* are angularly displaced in directions reverse to each other around a rotation center of the basic body 40, i.e., a rotation center of the rotating shaft 41.

The distance between the gripper plate 50 and the gripper jaw 51 of the gripper drum 4 is adjusted by the simultaneous angular displacements of the first side plates 42*a,* 42*b* and the second side plates 43*a,* 43*b* in the directions reverse to each other. The gripper plate shaft 52 is displaced by rotating the first side plates 42*a,* 42*b* in accordance with the rotations of the first side plates 42*a,* 42*b*. Thus, the cam follower 56 attached to the gripper plate shaft 52 through the arm 55 is moved and displaced along the groove cam 57. The gripper plate shaft 52 is angularly displaced by this displacement of the cam follower 56 through the arm 55. The gripper plate 50 is slightly changed by this displacement of the cam follower 56 in timing of an open-close operation with respect to the gripper jaw 51, but there is no influence on a gripper action.

This invention relates to the rotary drum of the folding device, and a driving source for operating an operating portion is arranged in the rotary drum so as to operate the adjusted portion arranged in the rotary drum during rotation, and its driving power source is arranged in the same rotary drum. Further, the driving source is operated by a wireless signal from the exterior of the rotary drum. Accordingly, it is not necessary to arrange a supply system in which there is a fear that sparks and noises causing a reduction in durability are generated by mechanical contact of a slip ring, etc. in each of the supply of electric power for operating and the supply of an operation signal from the rotary drum to the adjusting operation mechanism.

In this invention, it is possible to remove a relatively complicated mechanical construction for operating an adjusting portion of the rotary drum of the folding device from the exterior. Further, the rotary drum having the adjusted portion can be simply constructed by a small number of parts, and initial cost can be reduced.

Since the mechanism becomes simple, defects caused in the mechanism are reduced, and the mechanism is easily maintained so that the burden of a worker is reduced and running cost can be reduced.

Further, since there is no system using the mechanical contact in the supply of electric power and the supply of the control signal to the driving source of the adjusting operation mechanism, no contact portion is mechanically worn and the generation of sparks and noises can be removed. Therefore, it is possible to reduce a machine stopping time for maintenance of a portion of the power supply and the supply of the operation signal and exchanging parts so that working efficiency can be greatly improved.

What is claimed is:

1. A rotary drum of a folding device comprising:

a reference portion having a rotating shaft and a basic body rotated integrally with the rotating shaft;

an adjusted portion able to be rotated integrally with the reference portion and arranged so as to be displaced with respect to the reference portion;

an adjusting operation mechanism having a driving source for displacing the adjusted portion with respect to the reference portion, a power source arranged in the reference portion, a control board additionally arranged in the driving source and having a wireless receiving function, and a wireless operation machine for wirelessly transmitting an operation signal to the control board; and an adjusting transmission mechanism for transmitting a movement of the driving source to the adjusted portion;

wherein electric power is supplied from the power source to the driving source, and the driving source is operated by a wireless signal from the adjusting operation mechanism.

2. A rotary drum of a folding device comprising:

a reference portion having a rotating shaft and a basic body rotated integrally with the rotating shaft;

an adjusted portion able to be rotated integrally with the reference portion and arranged so as to be displaced with respect to the reference portion, and having a shaft arranged in the basic body and displaced by a torsion spring in one direction, an eccentric portion arranged in the shaft, a block member arranged rotatably with respect to the eccentric portion, and an outer circumferential member spanned between a pair of block members;

an adjusting operation mechanism having an electric motor as a driving source for displacing the adjusted portion with respect to the reference portion, a power source arranged in the reference portion, a control board additionally arranged in the driving source and having a wireless receiving function, and a wireless operation machine for wirelessly transmitting an operation signal to the control board; and an adjusting transmission mechanism having a warm arranged in an output shaft of the electric motor to transmit a movement of the electric motor to the adjusted portion, a warm wheel engaged with the warm and attached so as to be rotated integrally with the rotating shaft, a first gear able to be rotated with respect to the rotating shaft and attached to the electric motor, and a second gear engaged with the first gear and attached so as to be rotated integrally with the shaft;

wherein electric power is supplied from the power source to the electric motor, and the electric motor is operated by a wireless signal from the adjusting operation mechanism.

3. A rotary drum of a folding device comprising:

a reference portion having a rotating shaft and a basic body rotated integrally with the rotating shaft;

an adjusted portion able to be rotated integrally with the reference portion and arranged so as to be displaced with respect to the reference portion, and having pairs of first and second side plates arranged rotatably with respect to the basic body on both sides of the basic body, a third side plate attached to the other side of the basic body from outer sides of these first and second side plates and able to be rotated integrally with the basic body, an adjusting shaft rotatably arranged in the basic body,and the third side plate, a first eccentric cam attached through a first slip member movable only in a radial direction of the first side plate in a position of the adjusting shaft corresponding to the first side plate, a second eccentric cam attached through a second slip member movable only in a radial direction of the second side plate in a position of the adjusting shaft corresponding to the second side plate, an angular displacement shaft able to be angularly displaced and spanned between the first side plates, a displacing member attached to the angular displacement shaft, and a fixing member fixedly arranged so as to be opposed to the displacing member between the second side plates;

an adjusting operation mechanism having an electric motor attached to the third side plate as a driving source for displacing the adjusted portion with respect to the reference portion, a power source arranged in the reference portion, a control board additionally arranged in the driving source and having a wireless receiving function, and a wireless operation machine for wirelessly transmitting an operation signal to the control board;

an adjusting transmission mechanism having a warm arranged in an output shaft of the electric motor to transmit a movement of the electric motor to the adjusted portion, and a warm wheel engaged with the warm and attached so as to be rotated integrally with the adjusting shaft;

wherein electric power is supplied from the power source to the electric motor, and the electric motor is operated by a wireless signal from the adjusting operation mechanism.

4. The rotary drum of the folding device as defined in claim 1, 2 or 3, wherein the power source is a rotary transformer in which a coil is wound around each cut iron core portion, and one side is set to a fixing winding portion externally fixed and able to supply electric power from the exterior, and the other side is a rotation winding portion able to be rotated together with the reference portion.

5. The rotary drum of the folding device as defined in claim 2, wherein the power source is a generator constructed by a magnet externally fixed and a winding portion surrounding the magnet in a state close to a peripheral portion of the magnet such that the winding portion can be rotated together with the reference portion.

6. The rotary drum of the folding device as defined in claim 3, wherein the power source is a generator constructed by a magnet externally fixed and a winding portion surrounding the magnet in a state close to a peripheral portion of the magnet such that the winding portion can be rotated together with the reference portion.

7. The rotary drum of the folding device as defined in claim 1, wherein the power source is a generator constructed by a magnet externally fixed and a winding portion surrounding the magnet in a state close to a peripheral portion of the magnet such that the winding portion can be rotated together with the reference portion.

* * * * *